US007487561B2

(12) United States Patent
Ho

(10) Patent No.: US 7,487,561 B2
(45) Date of Patent: Feb. 10, 2009

(54) FLAT SHEET AND FITTED SHEET ASSEMBLY

(75) Inventor: Stanley Ho, Warren, NJ (US)

(73) Assignee: Allure Home Creation Co., Inc., Boonton, NJ (US)

( * ) Notice: Subject to any disclaimer, the term of this patent is extended or adjusted under 35 U.S.C. 154(b) by 0 days.

(21) Appl. No.: 11/488,809

(22) Filed: Jul. 17, 2006

(65) Prior Publication Data

US 2007/0101496 A1 May 10, 2007

Related U.S. Application Data

(63) Continuation-in-part of application No. 11/285,877, filed on Nov. 23, 2005, now Pat. No. 7,290,301.

(51) Int. Cl.
*A47G 9/02* (2006.01)
*A47G 9/04* (2006.01)

(52) U.S. Cl. ..... 5/497; 5/482; 5/494; 5/496; 5/500; 5/502

(58) Field of Classification Search ..... 5/497, 5/482, 485, 494, 496, 499, 500, 502
See application file for complete search history.

(56) References Cited

U.S. PATENT DOCUMENTS

| | | | | |
|---|---|---|---|---|
| 3,258,789 A | | 7/1966 | Banks | 5/485 |
| 3,962,739 A | | 6/1976 | Crockett | 5/497 |
| 3,965,504 A | | 6/1976 | Ainsworth | 5/485 |
| 4,035,854 A | | 7/1977 | Pardee | 5/497 |
| 4,266,308 A | | 5/1981 | Shatz | 5/494 |
| 4,384,380 A | | 5/1983 | Glaha et al. | 5/485 |
| 4,411,034 A | | 10/1983 | Williams | 5/494 |
| 4,615,061 A | * | 10/1986 | Scott | 5/497 |
| 4,924,543 A | | 5/1990 | Hoss et al. | 5/484 |
| 5,020,177 A | | 6/1991 | Etherington | 5/496 |
| 5,099,531 A | | 3/1992 | Schmier | 5/692 |
| 5,208,926 A | | 5/1993 | Stackhouse | 5/482 |
| 5,321,862 A | | 6/1994 | Campbell | 5/482 |
| 5,375,274 A | | 12/1994 | Cuneo | 5/497 |
| 5,729,847 A | | 3/1998 | Allardice | 5/502 |
| 5,794,285 A | | 8/1998 | Burch | 5/497 |
| 5,884,349 A | * | 3/1999 | Gretsinger | 5/502 |
| 5,901,389 A | | 5/1999 | Manner | 5/497 |
| 5,996,148 A | * | 12/1999 | McCain et al. | 5/497 |

(Continued)

FOREIGN PATENT DOCUMENTS

GB 2219740 A 12/1989

*Primary Examiner*—Robert G Santos
(74) *Attorney, Agent, or Firm*—Frommer Lawrence & Haug LLP

(57) ABSTRACT

A bedding assembly including at least a first sheet, preferably one fitted sheet having a head end and a foot, at least a second sheet, preferably one flat sheet having a head end and a foot end to be placed atop the said second sheet, an elastomeric component either removably attached to the first sheet or the second sheet; or affixed to the first sheet or the second sheet; or woven into the first sheet or the second sheet, connecting the flat sheet to the fitted sheet at least one portion of a foot end of the bedding assembly, and fastening means connecting the fitted sheet to the flat sheet along at least one portion of one edge of the foot end of the fitted sheet.

17 Claims, 9 Drawing Sheets

U.S. PATENT DOCUMENTS

| | | | | |
|---|---|---|---|---|
| 6,044,503 | A | 4/2000 | McClendon | 5/482 |
| 6,061,851 | A | 5/2000 | Crowell | 5/497 |
| 6,088,852 | A | 7/2000 | Quandt | 5/482 |
| 6,098,219 | A | 8/2000 | Milber | 5/494 |
| 6,108,836 | A | 8/2000 | Keene, III | 5/497 |
| 6,122,783 | A | 9/2000 | Herndon et al. | 5/496 |
| 6,134,730 | A | 10/2000 | Evanson | 5/482 |
| 6,353,947 | B1 * | 3/2002 | McCain et al. | 5/500 |
| 6,427,266 | B2 | 8/2002 | Talley-Williams | 5/482 |
| 6,499,157 | B1 * | 12/2002 | McCain et al. | 5/497 |
| 6,725,477 | B2 | 4/2004 | Ciaglia et al. | 5/497 |
| 6,859,962 | B2 | 3/2005 | Diak/Ghanem | 5/499 |
| 6,886,197 | B1 | 5/2005 | Madigan | 5/482 |
| 7,231,679 | B2 * | 6/2007 | Ho | 5/497 |
| 7,290,301 | B2 * | 11/2007 | Ho | 5/496 |
| 2002/0088054 | A1 * | 7/2002 | McCain et al. | 5/500 |
| 2007/0101496 | A1 * | 5/2007 | Ho | 5/497 |
| 2007/0113341 | A1 * | 5/2007 | Ho | 5/497 |
| 2007/0118988 | A1 * | 5/2007 | Ho | 5/496 |
| 2008/0010746 | A1 * | 1/2008 | Ho | 5/482 |
| 2008/0040855 | A1 * | 2/2008 | Ho | 5/482 |

* cited by examiner

FLAT SHEET AND FITTED SHEET ASSEMBLY

CROSS-REFERENCE TO RELATED APPLICATION

This application is a continuation-in-part application of commonly owned application entitled "Bedding Assembly and Comforter Fastener," filed Nov. 23, 2005 now U.S. Pat. No. 7,290,301 and given the Ser. No. 11/285,877, the disclosure of which is incorporated herein by reference.

FIELD OF THE INVENTION

The present invention relates, in general, to a bedding assembly and means for maintaining the bedding assembly on a bed while in use and for simplifying bed making.

BACKGROUND

Various specific types and designs of bedclothes, commonly including various covering (as sheets, comforters, bed skirts, pillow cases) used on a bed, are known to those skilled in the art. However, it is often the case that when in use these bedclothes slip off of the bed resulting in a chilling effect on the user, or when not in use once these items have slipped off of the bed there are additional challenges necessary to remake the bed, or that it is rather cumbersome to change the sheets. When using traditional bed sheets, each separate piece is put on the bed one at a time.

Bed covering designs and arrangements in common use have remained largely unchanged for many years, and generally involve the use of a bottom sheet to cover the mattress, a top sheet to cover a sleeper lying on the bottom sheet, and additional blankets or coverings placed above the top sheet when needed or desired. Fitted bottom sheets, with a pocket at each corner to fit around and under the mattress, have been known for some time and have become the conventional design because they are easily installed and removed, and they stay in place much more reliably than plain flat sheets. In the conventional approach, however, separate flat top sheet have continued to be the norm, despite disadvantages and problems with their use. Those disadvantages and problems include difficulty in properly aligning the top sheet on the mattress; difficulty in tucking the ends and edges of the top sheet under the mattress, especially when the bed is placed with one side against a wall or access to one side is otherwise obstructed; and difficulty in maintaining the position and attachment of the top sheet during use.

The present invention addresses the shortcomings of the prior art and the conflicting criteria of typical users.

SUMMARY OF THE INVENTION

It is the object of the present invention to overcome the shortcomings of the prior art and make bed-making, sheet-changing more efficient as a way of improving a user's sleep by securing one of the bedding on the bed without constraining the user's movement during sleep.

One aspect of the present invention is directed to a bedding assembly including at least one fitted sheet having a head end and a foot end for covering a mattress, and at least one flat sheet having a head end and a foot end for covering said fitted sheet, and fastening means connecting the fitted sheet to the flat sheet along at least one portion of one edge of the fitted sheet.

Another aspect of the present invention is directed to a method of making a bed including the steps of providing a bedding assembly including at least one fitted sheet having a head end and a foot end for covering a mattress, at least one flat sheet having a head end and a foot end for covering said fitted sheet, and fastening means connecting the fitted sheet to the flat sheet along at least one portion of one edge of the fitted sheet. The method further includes steps of overlaying the mattress with the flat sheet and fitted sheet combination, and removably attaching the fitted sheet to the mattress, so as to secure the fitted sheet flat sheet assembly in an aesthetically pleasing arrangement.

Another aspect of the invention is directed to a bedding assembly including at least one fitted sheet having a head end and a foot end for covering a mattress, at least one flat sheet having a head end and a foot end for covering said fitted sheet, an elastomeric component either removably assembled or affixed to the flat sheet or woven into the flat sheet, whereby the flat sheet having the elastomeric component is connected to the fitted sheet at least at one portion of one edge of the fitted sheet and preferably at the foot end.

In this text, the terms "comprising", "comprise", "comprises" and other forms of "comprise" can have the meaning ascribed to these terms in U.S. Patent Law and can mean "including", "include", "includes" and other forms of "include".

The various features of novelty which characterize the invention are pointed out in particularity in the claims annexed to and forming a part of this disclosure. For a better understanding of the invention, its operating advantages and specific objects attained by its uses, reference is made to the accompanying descriptive matter in which preferred embodiments of the invention are illustrated in the accompanying drawings in which corresponding components are identified by the same reference numerals.

BRIEF DESCRIPTION OF THE DRAWINGS

In the following detailed description of the invention, reference will be made to the accompanying drawings, incorporated herein by reference, wherein.

DETAILED DESCRIPTION

Figure 1:
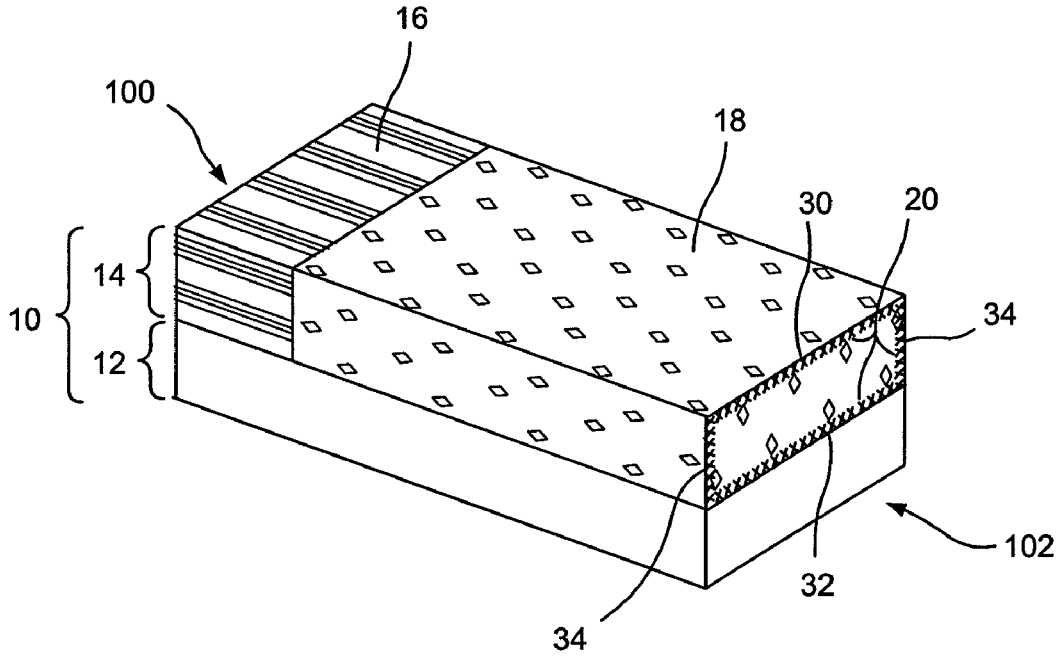
FIG. 1 is a perspective view of a first embodiment of the present invention.

A first embodiment of the present invention can be found in FIG. 1, where a perspective view of a typical bed 10 having a head end 100 and a foot end 102 can be seen. The bed 10 includes a mattress 14 and a box spring 12. The mattress 14 is covered with a fitted sheet 16, and a top or flat sheet 18 covering the fitted sheet 16. As shown in FIG. 1, at the foot end 102, the top sheet 18 and the fitted sheet 16 are joined at least at one portion of one side, but preferably joined at the foot end of the top or flat sheet. In a preferred embodiment, the three remaining ends, namely the head end 100 and the two sides are free and allow for movement. In some arrangements it may be desirable that one of the sides also be attached to the fitted sheet 16, as will be discussed below.

As shown in FIG. 1 the top sheet 18 is connected to the fitted sheet 16 along four edges, namely the top horizontal edge 30, a bottom horizontal edge 32, and the two vertical side edges 34. This is demonstrated in the figure by fastening means 20. The fastening means 20 secures the top sheet 18 to the fitted sheet 16 and ensure that at least on the foot end 102 of the bed 10, the flat sheet will be secured to the bed. It has been found that securing the foot end 102 of the flat sheet 18 greatly enhances the likelihood that the flat sheet 18 will not be kicked of the bed 10 while the user is sleeping. In addition, the flat sheet 18 as shown in FIG. 1 makes it much easier to change the bedding than traditional flat sheets, since the flat sheet is already secured to the fitted sheet 16 in the location where traditional hospital corners would be installed at least one portion of the foot end 102 of the bed 10.

Figure 5:
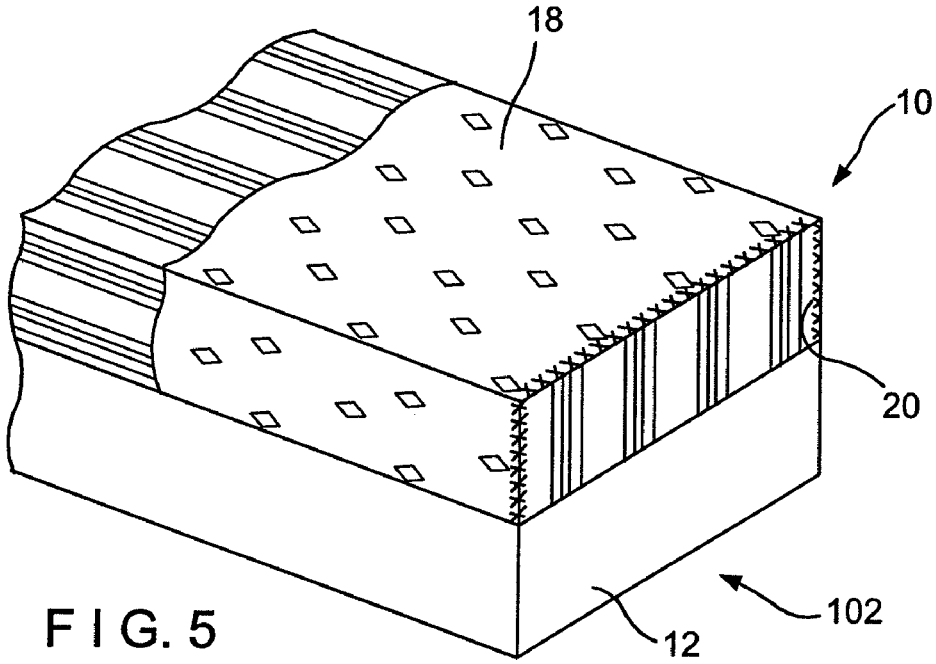
FIG. 5 is a perspective view of a fifth embodiment of the present invention.

It has been determined that to improve correlation (connectivity) between the top sheet 18 and the fitted sheet 16, at least one portion of one of the edges 30-34 must be coupled with tope sheet 18, and preferably two of the edges 30-34. More preferably, the edges that are connected are adjacent edges but not parallel edges. More preferably still, at least three edges are connected to strengthen the combination of the fitted sheet 16 to the top sheet 18, as shown in FIG. 5.

Figure 2:
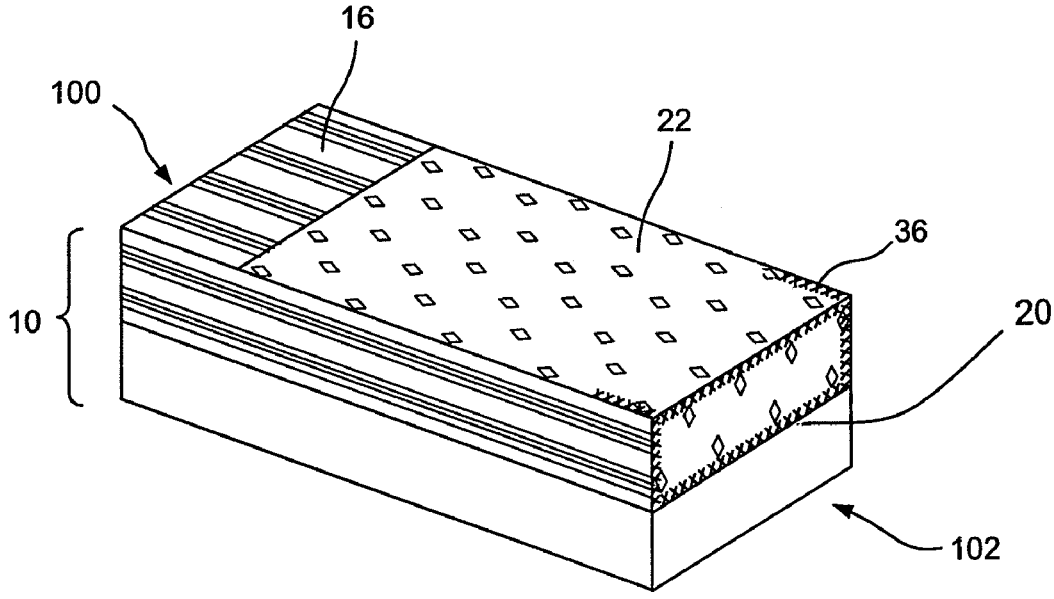
FIG. 2 is a perspective view of a second embodiment of the present invention.

FIG. 2 shows a second embodiment of the present invention. In FIG. 2, the flat sheet 18 is formed so that it only covers the top surface of the fitted sheet 16. This type of design has the advantage of reducing the bulkiness of extra fabric from the flat sheet from hanging over the edge of the mattress and may enhance the aesthetic appearance of bed 10 when made. An additional benefit of this embodiment is that it takes less water and soap to launder the bedding assembly and also saves space during storage. Another feature of the aspect of the present invention shown in FIG. 2 is the addition of fastening means 20 on the side 36 of the mattress. Fastening means 20 on the side 36 of the mattress further strengthens the bond between the flat sheet 18 to the fitted sheet 16, and minimizes the likelihood that the flat sheet 18 would separate from the fitted sheet 16 when in use. Although shown in FIG. 2 as having all four edges 30-34 of the flat sheet 18 attached to the fitted sheet 16, this is not required. As discussed above, joining at least one portion of one edge of the flat sheet 18 to the fitted sheet 16 is necessary to fasten the bedding assembly securely on the bed. In a preferred embodiment, preferably two or more edges are connected; however, it is not necessary to join the entire length of the edge.

Figure 3:
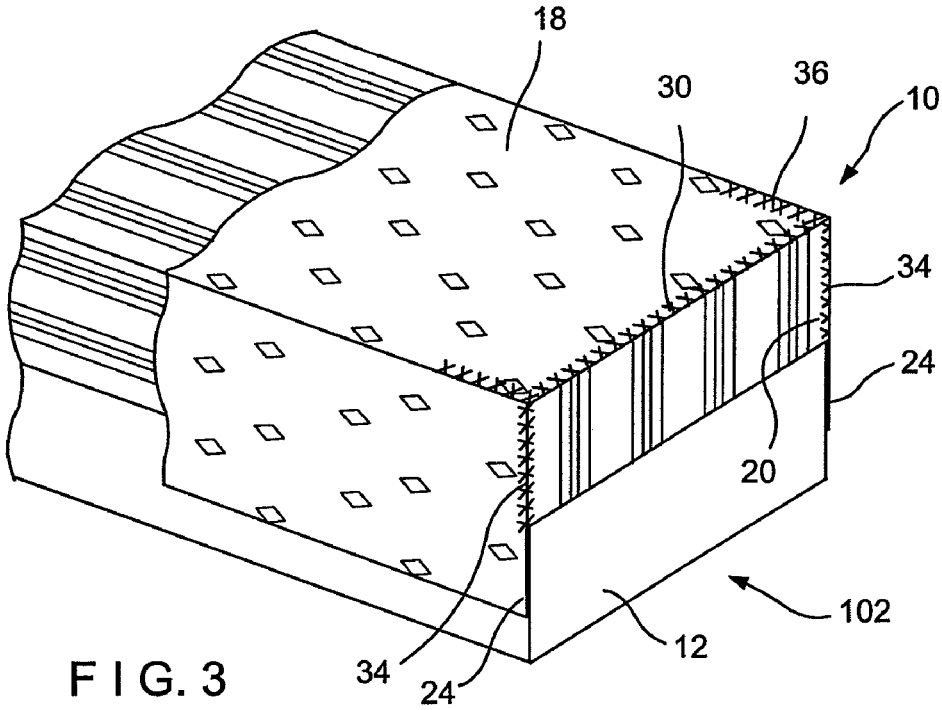
FIG. 3 is a perspective view of a third embodiment of the present invention.

FIG. 3 shows a further aspect of the present invention. The mattress in FIG. 3 is covered with a fitted sheet which itself is covered with a flat sheet 18. The flat sheet 18 is connected to the fitted sheet on edges 30 and 34. In addition, the flat sheet 18 is joined or coupled on a portion of the two lengthwise edges 36. The flat sheet 18 also includes flaps 24 which extend over the mattress and at least partially cover the box spring 12.

Figure 4:
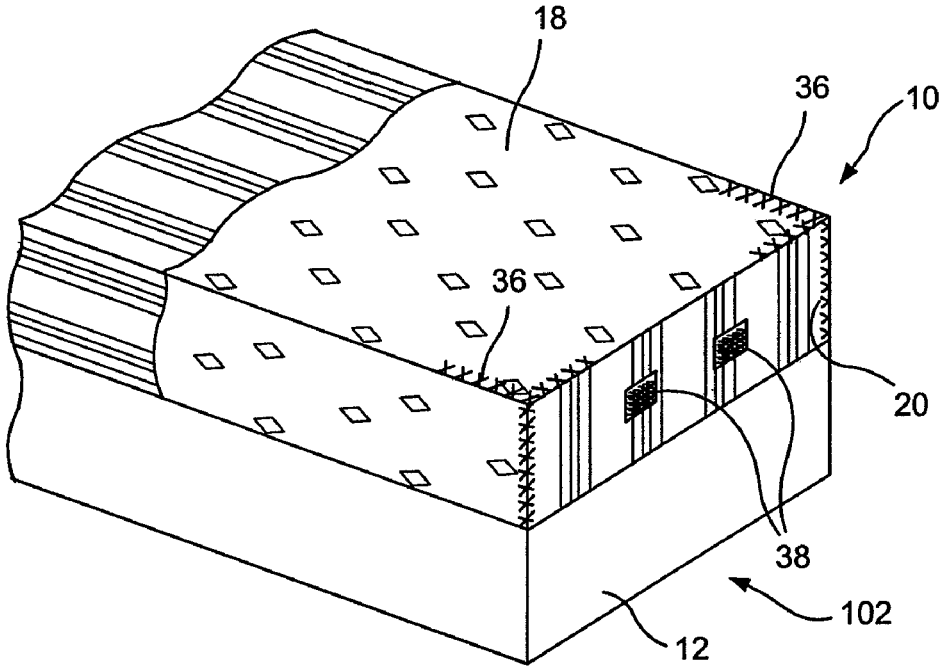
FIG. 4 is a perspective view of a fourth embodiment of the present invention.

Yet a further aspect of the present invention is shown in FIG. 4. FIG. 4 depicts a flat sheet 18 joined to a fitted sheet along only a portion of the horizontal edge 30. Specifically, FIG. 4 shows fastening means along a portion of horizontal edge 30 that is closest to the corners of the bed. Accordingly, it is not necessary that an entire edge of the flat sheet 18 be jointed or connected or assembled to the fitted sheet in order to secure the flat sheet to the fitted sheet. As shown in FIG. 4, only portions of the lengthwise edges 36 and a portion of the horizontal edge 30 are joined to the fitted sheet 16. Though shown as having the entirety of vertical edges 34 assembled together, one skilled in the art will appreciate that only a portion of these vertical edges need to be fastened. The fasteners 20 may be of the type including but not limited to stitches 20, hook and eye, hook and loop, buttons, snaps and others known to those of skill in the art.

A further aspect of the present invention are the two attachment means 38 positions on the fitted sheet 16. The use of these attachment means is described in greater detail in commonly owned U.S. patent application entitled "Comforter Fastener" filed Nov. 7, 2005, which is incorporated herein by reference, and where it is described that the attachment means 38 may be for, example, hook and loop fasteners sold under the trade name Velcro® or any conventional fastening means. Alternatively, the attachment means could be buttons, snaps, zippers, or other fastening means known to those of one skilled in the art. Further, corresponding attachments means may be formed on a comforter or a duvet cover that is atop the bed 10 or fitted sheet 16. Through the use of the attachment means 38, the comforter is secured to the bed 10. When used in combination with the fitted and flat sheets 16 and 18 bedding assembly described above, the comforter provides additional warmth. The sheet combination with a comforter or any bedding is aesthetically pleasing and simplifies bed making and bed changing.

Figure 6:
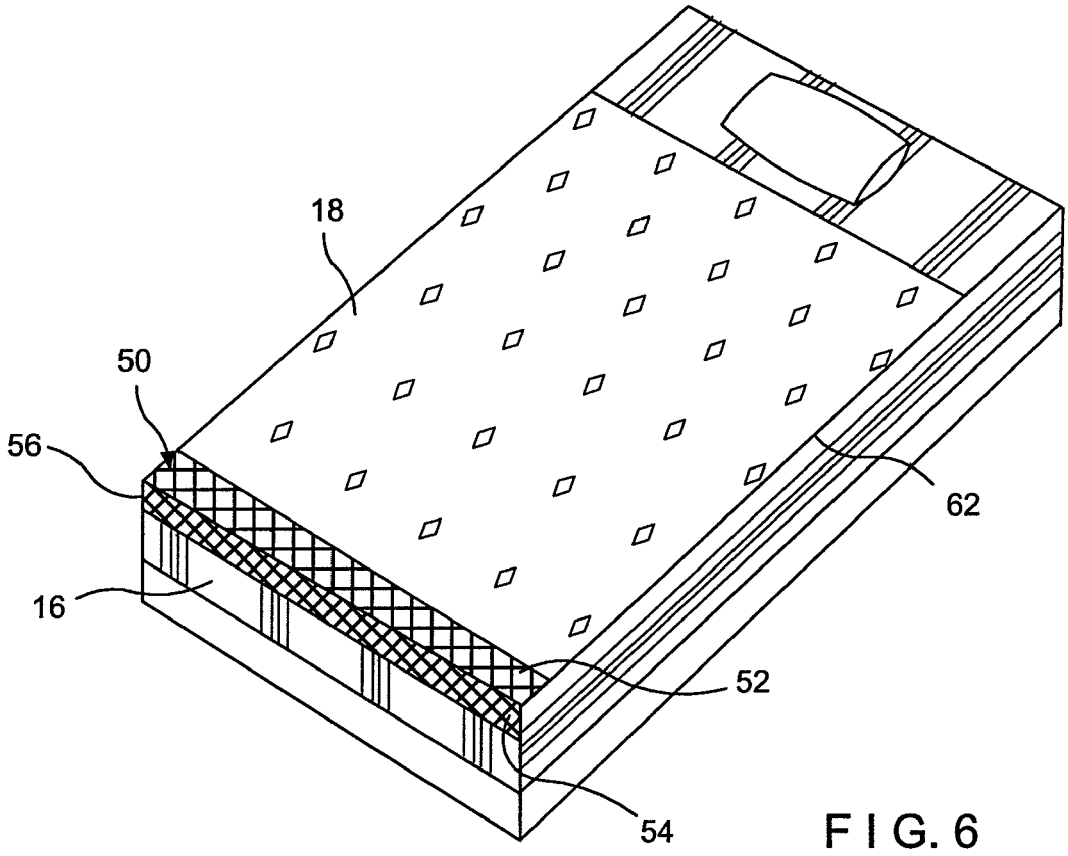
FIG. 6 is a perspective view of a sixth embodiment of the present invention.

A further aspect of the present invention can be seen in FIG. 6, depicting a flat sheet 18 joined to a fitted sheet 16. The flat sheet 18 shown in FIG. 6 includes an elastomeric component 50. As shown in FIG. 6, the elastomeric component 50 is woven into flat sheet 18 and includes an upper portion 52 and a lower portion 54. The elastomeric component 50 provides a stretchable area for the users to extend their feet beyond the length of the bed. By fastening the flat sheet 18 to the fitted sheet 16 and including this elastomeric component 50, the users are able to both extend their feet and also ensure that their feet will stay warm while they remain in bed.

In a preferred embodiment the fitted sheet 16 and the elastomeric component 50 may be sewn together along one or more horizontal edges 58, 60 and one of more vertical edges 56 of the fitted sheet 16.

Alternatively, the elastomeric component 50 is removably connected or affixed to the flat sheet 18 and/or the fitted sheet 16 along at least one portion of one or more vertical lines 56 and/or one or more horizontal lines 58, 60. Further, as will be described below with respect to FIGS. 10A and 10B, the elastomeric component need not be the entire width or length of the sheet.

Figure 7:
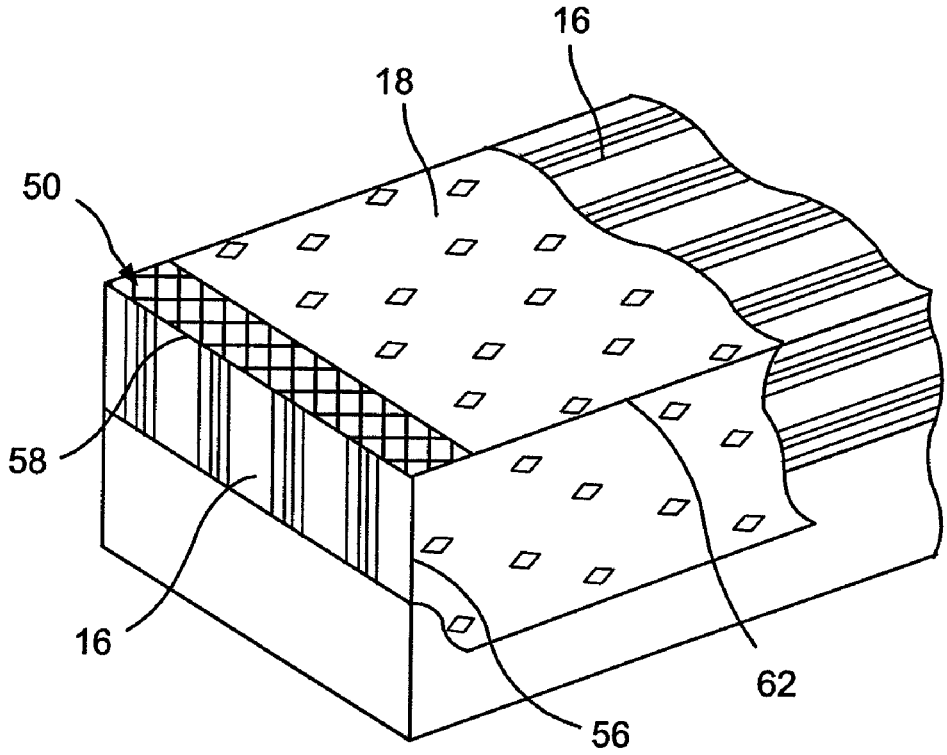
FIG. 7 is a perspective view of a seventh embodiment of the present invention.

FIG. 7 shows an alternative arrangement wherein instead of having and upper portion 52 and lower portion 54, the flat sheet 18 is fastened to the fitted sheet 16 along a portion of the top horizontal line 58. The elastomeric component 50 rests only on the top surface of the mattress.

Figure 8:
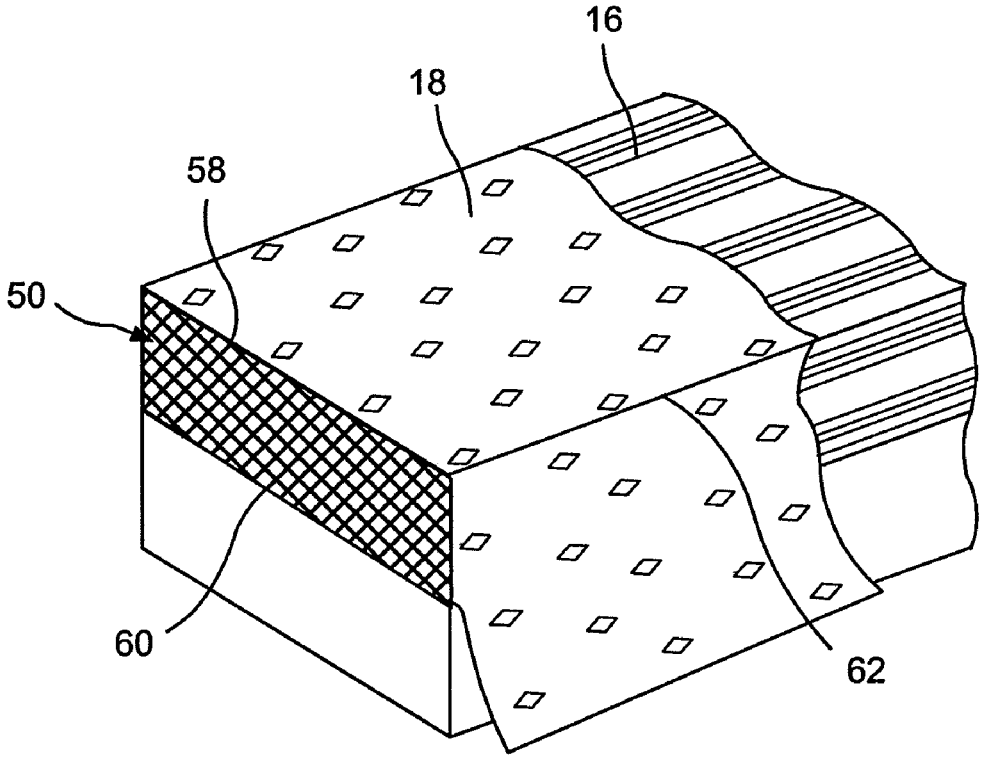
FIG. 8 is a perspective view of an eighth embodiment of the present invention.

FIG. 8 shows yet another alternative arrangement wherein the flat sheet 18 is fastened to the fitted sheet 16 along a horizontal line 60 at the bottom of the fitted sheet 18, but the elastomeric component does not extend beyond or substantially beyond the horizontal line 58 formed by the top of the mattress.

In each of the aspects of the present invention, the flat sheet 18 may be fastened or sewn to the fitted sheet 16 along at least one portion of the vertical line 56 of the mattress as described in FIG. 6. In addition, the flat sheet 16 may extend only to the horizontal edge 62 as shown in FIG. 6 or may extend over that edge as shown in FIGS. 7 and 8. Further, the elastomeric component 50 may be sewn or affixed to the fitted sheet 16 along at least a portion of the horizontal edge 62.

Figure 9:
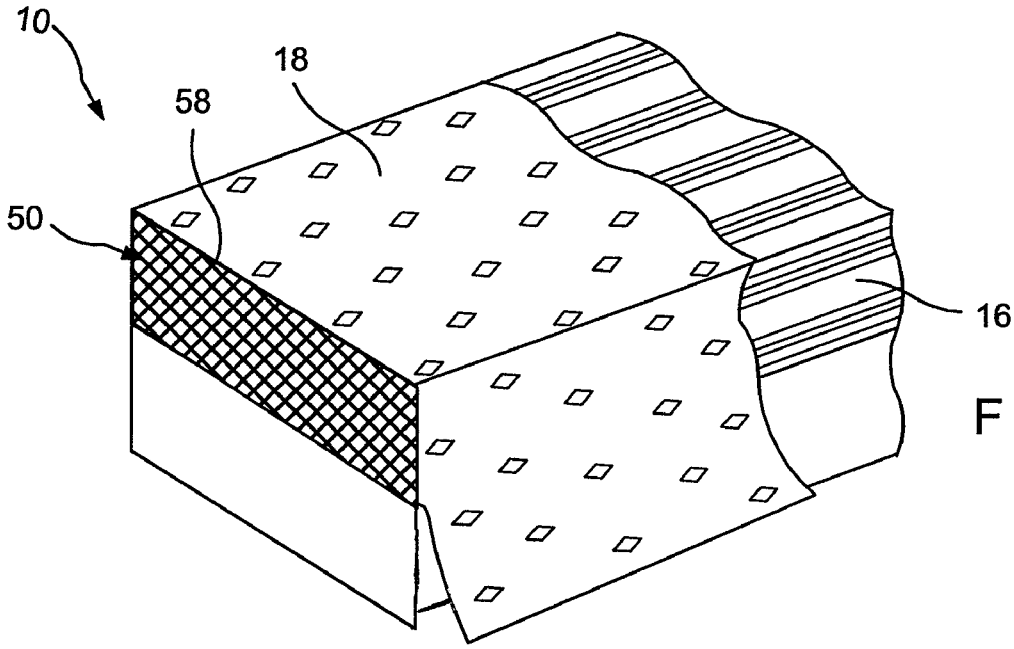
FIG. 9 is a perspective view of a ninth embodiment of the present invention whereby the elastomeric component is woven into the flat sheet.

FIG. 9 shows another aspect of the present invention where the elastomeric component 50 is woven to and formed integral with the flat sheet 18. As shown in FIG. 9, the elastomeric component 50 extends only to the horizontal line 58 formed at the top of the bed 10. However, the elastomeric component 50 need not be so limited and may extend onto the top surface of the bed as shown in FIG. 6.

The attachment of the flat sheet to the fitted sheet is preferably accomplished by fastening the flat sheet 18 to the fitted sheet 16 at least at one portion of one side of the foot end. As described above this may be along one or more of the horizontal or vertical lines of the bed 10. While a preferred embodiment to attach the fitted sheet 16 to the elastomeric component 50 by sewing, alternative methods of attachment including for example, hook and loop fasteners, buttons, snaps, and the like are considered within the scope of the invention.

Figure 10A:
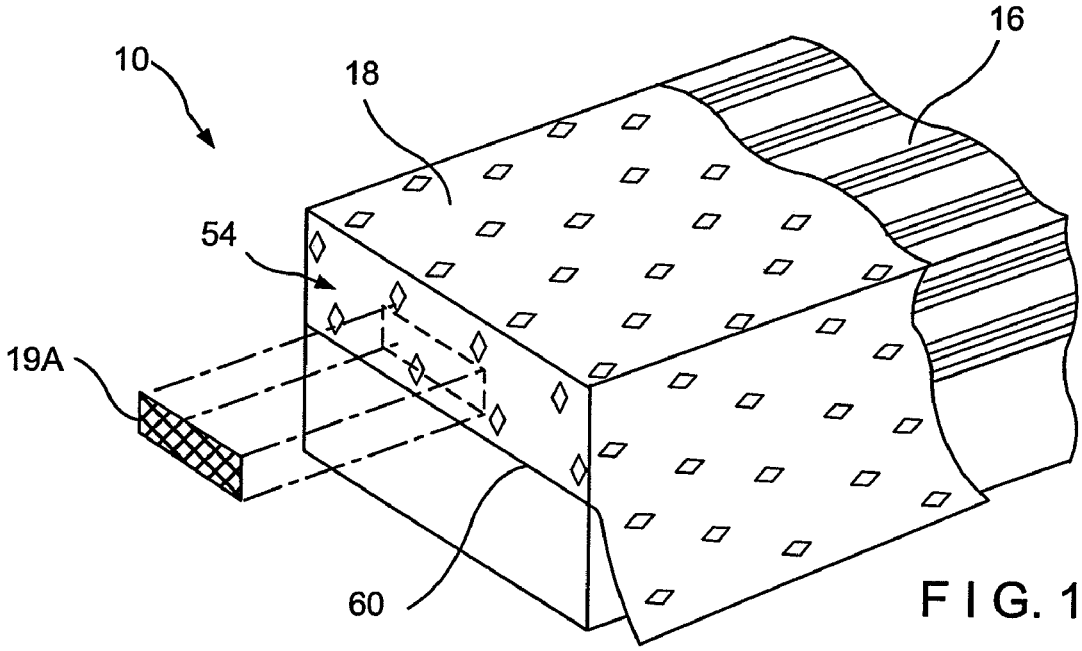
FIGS. 10A and 10B are a perspective view of a tenth embodiment of the present invention whereby the elastomeric component is either removably assembled or affixed to the flat sheet.
Figure 10B:
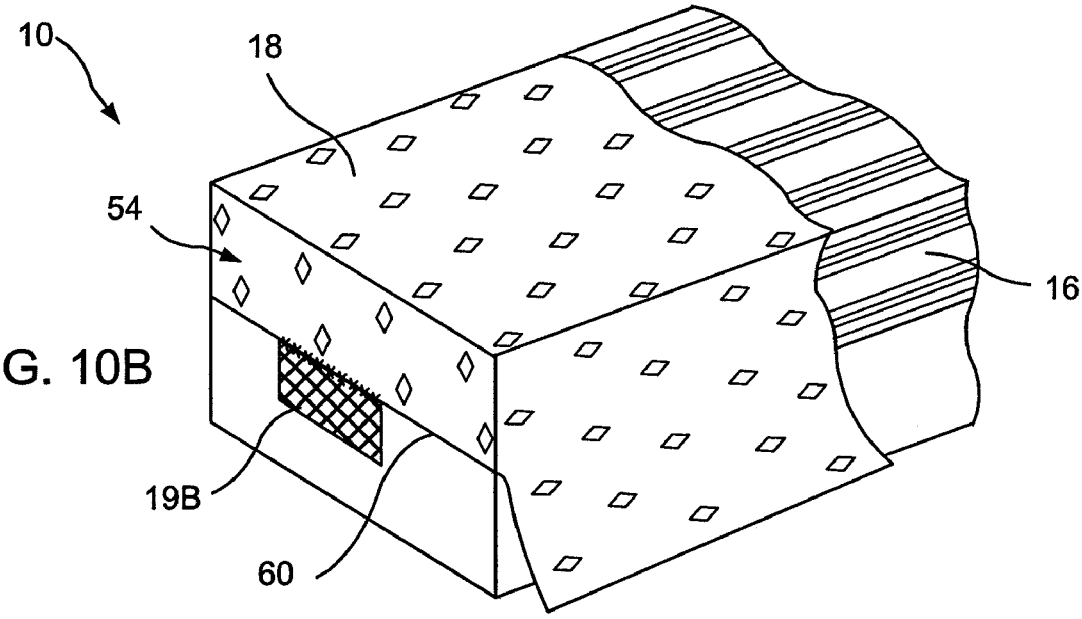

Another aspect of the present invention is shown in FIGS. 10A and 10B. Though described above as providing essentially a pocket in which a user's feet are secured within the elastomeric component 50, it is understood that some users prefer to have their feet free particularly if they become warm. In FIG. 10A, there is shown a removable elastomeric flap 19A. The elastomeric flap 19A, as shown in FIG. 10A is removeably affixed to the flat sheet 18 along a portion of the surface 54. The flap 19A in use is tucked under the mattress to secure the flat sheet 18 to the bed 10. The elasticity allows for movement of the flat sheet 18 when in use but prevents the flat sheet 18 from being completely kicked off of the bed 10. The flap 19A extends only along a portion of the horizontal line 60 of the bed 10. FIG. 10B shows yet another alternative, wherein the flap 19B is either sewn to the flat sheet 18 along the horizontal edge 60, or is woven integral with the flat sheet 18, again along the horizontal edge 60.

Other arrangements incorporating an elastomeric component 50 at the foot end of a bedding assembly to provide for additional foot room for the user would be apparent to one skilled in the art and are considered within the scope of the instant invention.

Having thus described in detail preferred embodiments of the present invention, it is to be understood that the invention defined by the above paragraphs is not to be limited to particular details set forth in the above description, as many apparent variations thereof are possible without departing from the spirit or scope of the present invention.

I claim:

1. A bedding assembly comprising:

at least one fitted sheet having a head end and a foot end;

at least one flat sheet having a head end and a foot end for covering said at least one fitted sheet;

an elastomeric component connecting the at least one flat sheet to the at least one fitted sheet at at least one portion of one end of the foot end; and fastening means connecting the elastomeric component between a horizontal edge of the foot end of the at least one flat sheet and a substantially upper horizontal edge of the at least one fitted sheet, wherein the elastomeric component is woven into and formed integral with the at least one flat sheet.

2. The bedding assembly of claim 1, wherein said fastening means are also formed on at least one portion of a bottom horizontal edge of the at least one fitted sheet.

3. The bedding assembly of claim 1, wherein said fastening means are also formed on at least one portion of a vertical edge of the at least one fitted sheet.

4. The bedding assembly of claim 1, wherein said fastening means are also formed on at least one portion of one lengthwise edge of the at least one fitted sheet.

5. The bedding assembly of claim 1, wherein said fastening means are also formed on two or more of the edges selected from the top horizontal, the bottom horizontal edge, the vertical edges, and the lengthwise edges.

6. The bedding assembly of claim 1, wherein said fastening means are also formed on three or more of the edges selected from the top horizontal, the bottom horizontal edge, the vertical edges, and the lengthwise edges.

7. The bedding assembly of claim 1, wherein said fastening means are also formed only on a portion of one or more edges selected from the group consisting of the top horizontal, the bottom horizontal edge, the vertical edges, and the lengthwise edges.

8. The bedding assembly of claim 1, wherein the at least one flat sheet and elastomeric component extend only to the edge of the at least one fitted sheet.

9. The bedding assembly of claim 1 whereby the elastomeric component is removably attached to the foot end.

10. The bedding assembly of claim 1 whereby the elastomeric component is affixed to the at least one flat sheet.

11. The bedding assembly of claim 1 whereby the elastomeric component is removably attached to the at least one fitted sheet.

12. The bedding assembly of claim 1 whereby the elastomeric component is affixed to the at least one fitted sheet.

13. The bedding assembly of claim 1 whereby the elastomeric component is also woven into the at least one fitted sheet.

14. A bedding assembly comprising:

a first sheet having a foot end with a horizontal edge, a second sheet having a foot end with a substantially upper horizontal edge substantially vertically disposed above a substantially lower horizontal edge, and an elastomeric component removably connected between the horizontal edge of the first sheet and the substantially upper horizontal edge of the second sheet by a fastening means, wherein the elastomeric component is woven into and formed integral with the first sheet.

15. The bedding assembly as claimed in claim 1 or 14, whereby the fastening means comprises stitches, hook and loop fasteners, hook and eye or buttons.

16. The bedding assembly as claimed in claim 14, whereby the second sheet is a fitted sheet.

17. The bedding assembly as claimed in claim 14, whereby the first sheet is a flat sheet.

* * * * *